United States Patent [19]

Bailey

[11] 4,346,582

[45] Aug. 31, 1982

[54] METHOD FOR FLATTENING CORRUGATED HEAT EXCHANGER PLATES

[75] Inventor: John M. Bailey, Dunlap, Ill.

[73] Assignee: Caterpillar Tractor Co., Peoria, Ill.

[21] Appl. No.: 165,831

[22] PCT Filed: Jan. 28, 1980

[86] PCT No.: PCT/US80/00082

§ 371 Date: Jan. 28, 1980

§ 102(e) Date: Jan. 28, 1980

[87] PCT Pub. No.: WO81/02121

PCT Pub. Date: Aug. 6, 1981

[51] Int. Cl.[3] ..... B21D 13/02; B21D 37/08; B21D 43/02; B21D 53/04

[52] U.S. Cl. ..... 72/379; 72/375; 72/404; 72/469; 72/17; 72/31

[58] Field of Search ..... 72/373–375, 72/379, 404, 405, 414, 415, 472, 376, 469, 385; 113/1 C, 118 D, 118 R; 29/157.3 D, 157.3 R; 165/166, 167, 170

[56] References Cited

U.S. PATENT DOCUMENTS

| | | | |
|---|---|---|---|
| 1,462,475 | 7/1923 | Atkinson | 72/374 |
| 2,988,033 | 6/1961 | Gapp | 29/157.3 D |
| 3,759,323 | 9/1973 | Dawson et al. | 165/166 |
| 4,022,050 | 5/1977 | Davis et al. | 72/379 |
| 4,109,503 | 8/1978 | Francon et al. | 72/352 |

FOREIGN PATENT DOCUMENTS

| | | | |
|---|---|---|---|
| 713776 | 8/1954 | United Kingdom | 29/157.3 D |

*Primary Examiner*—Lowell A. Larson

*Attorney, Agent, or Firm*—Sixbey, Friedman & Leedom

[57] ABSTRACT

A method and apparatus (32) is provided for crushing a portion of a corrugated sheet (10) in an area (20, 22) extending transversely to the corrugations in the sheet without blocking the passages (14) between the crowns (12) of the uncrushed portions of the corrugated sheet (10). In accordance with the method, spacing members (58–66 and 78–88) are inserted into each of the passages (14) on either side of a ridge (12) to be crushed, and the ridge (12) between the spacing members (58–66 and 78–88) is crushed before the spacing members (58–66 and 78–88) are withdrawn. The apparatus for crushing the sheet (10) includes opposed die members (34, 36), each having a plurality of blades (58–66 and 78–88) spaced by slots (68–76 and 90–98). The slots (68–76 and 90–98) in each die member (34, 36) progressively decrease in depth and are positioned to receive the blades (58–66 and 78–88) of the opposed die member. A control circuit (46) causes the die members (34, 36) to engage each time a passage (14) in the corrugated sheet (10) is aligned with a blade (58–66 and 78–88) in a die member (34, 36).

6 Claims, 6 Drawing Figures

METHOD FOR FLATTENING CORRUGATED HEAT EXCHANGER PLATES

DESCRIPTION

1. Technical Field

The present invention relates generally to heat exchangers and more particularly to a method for use in the formation of thin metal plates used in such heat exchangers.

2. Background Art

Primary surface recuperators have been developed which incorporate thin alloy metal sheets that have been corrugated or folded to produce passages on both sides of each sheet. These passages serve to direct the flow of air and hot gasses, and heat is transferred directly through the sheets which are suitably welded together to prevent the flow of air into the gas passages. The corrugations in the sheet surface also serve to support adjacent sheets in the assembly.

Before the sheets are assembled, edge portions of the sheets are crushed to provide flattened header sections which will facilitate the cross flow of fluid. These header sections at each end of the sheet receive or deliver the air or gas from or to the appropriate passages of the assembly.

A stacked plate heat exchanger of the type described is illustrated by U.S. Pat. No. 3,759,323 to Harry J. Dawson et al. In fabricating heat exchangers of this type, difficulties have been encountered in flattening the header sections. The header sections extend transversely to the corrugations, and as the corrugations in the header sections are flattened, the corrugations expand and often completely or partially block the fluid passages defined by adjacent corrugations. Attempts to alleviate this problem have not been satisfactory. For example, comb-like devices have been employed in an attempt to open the blocked passages following the crushing of the header section corrugations, but since the blockages are irregularly spaced, the regularly spaced comb devices sometimes contribute to the blockage instead of removing it. Also the sheets have been staggered so that the transition blockage does not occur all at one zone and the fluid can pass over the blocked region, but this solution to the problem results in the use of excess heat exchanger material.

The foregoing illustrates the limitations of the known prior art. Thus it is apparent that it would be advantageous to provide an alternative to the prior art.

DISCLOSURE OF THE INVENTION

In one aspect the present invention provides a novel method for flattening corrugated heat exchanger plates to form header sections which includes separately and progressively crushing the corrugations in a transition zone between the fluid passages and a header section before forming the remainder of the header section.

Another aspect of the present invention is to provide a novel apparatus for flattening corrugated heat exchanger plates to form header sections which includes opposed die members for progressively crushing the corrugations in a transition zone, each die member having blades which are maintained on either side of a corrugation to limit the ability of the corrugation to expand or flare outwardly during the crushing operation.

The foregoing and other aspects will become apparent from the following detailed description of the invention when considered in conjunction with the accompanying drawings. It is to be expressly understood, however, that the drawings are not intended as a definition of the invention but are for the purpose of illustration only.

BEST MODE FOR CARRYING OUT THE INVENTION

Figure 1:
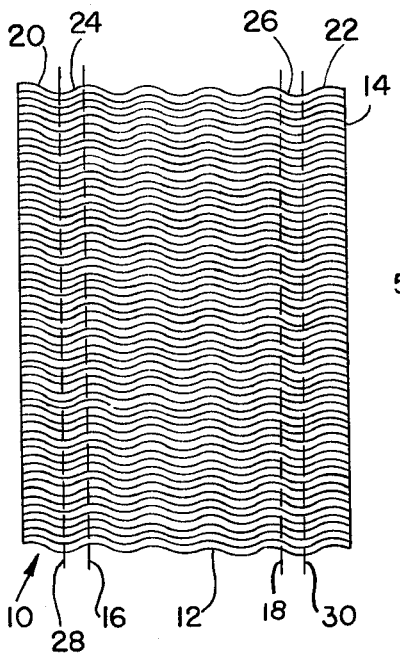
FIG. 1 is a plan view of a corrugated heat exchanger plate which is to be flattened to form header sections in accordance with the present invention.

Referring now to the drawings, FIG. 1 discloses a corrugated heat exchanger plate indicated generally at 10 formed from a thin metal or metal alloy sheet which has been corrugated to provide raised ridges having crowns or fins 12 which define intermediate passages 14. These crowns and passages are formed on both sides of the sheet 10, and when the sheet is assembled with similarly formed sheets, will define fluid passages on opposite sides of the sheet. The broken lines 16 and 18 in FIG. 1 designate header zones 20 and 22 which must be formed on either side of a central corrugated section by flattening the corrugations in the header zones. It is this flattening process which, in the past, has resulted in blockage of the passages 14 in the vicinity of the lines 16 and 18 due to expansion or flaring of the crowns 12 as they are crushed.

In accordance with the method of the present invention, the header zones 20 and 22 may be flattened without resulting in substantial blockage of the passages 14. This is accomplished by progressively crushing each individual crown 12 within transition zones 24 and 26 bordered by the lines 16 and 18 and broken lines 28 and 30 spaced therefrom. Each crown within a transition zone is subjected individually to a plurality of successive crushing steps during which the crown is progressively flattened. During each crushing step, die set support blades are inserted into the passages 14 on either side of the crown to act as spacers to prevent the crown from expanding outwardly to block the passages. Once the transition zones 24 and 26 are completely flattened, the remainder of the header zones outboard of the transition zones may be easily flattened in a conventional manner to form transversely extending headers on either side of a central corrugated section.

The preliminary progressive flattening of the corrugations in the transition zones 24 and 26 may be accomplished by feeding the corrugated heat exchanger plate 10 between opposed die members of a die set mechanism which closes once each time the plate moves for a distance equal to the distance between two adjacent crowns 12. As the crowns move beneath the die members, they are progressively received in slots of ever decreasing depth as the die members close. At least one passage 14 between the first crown to be crushed and the next adjacent crown to be crushed receives a die support blade which extends into the passage for substantially the total depth thereof to act as a locator blade for following die set blades. This locator blade also stabilizes and reinforces the heat exchanger plate 10 during the flattening operation.

Figure 2:
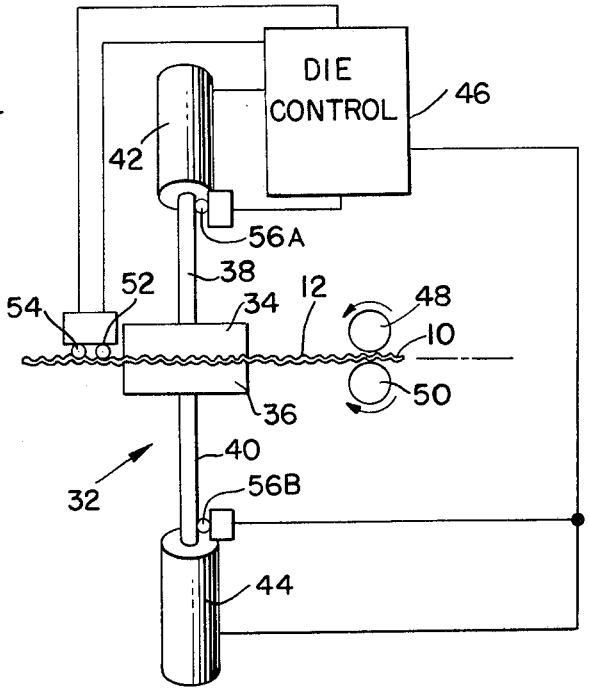
FIG. 2 is a diagrammatic illustration of the die assembly of the present invention for receiving a moving heat exchanger plate.

A novel die assembly 32 constructed in accordance with the present invention is illustrated diagrammatically in FIG. 2. This die assembly includes an upper die 34 and a lower die 36 having opposed die surfaces which are engaged and disengaged by the operation of upper and lower hydraulic cylinders 42 and 44 respectively. The upper and lower dies 34 and 36 are connected to hydraulic pistons in cylinders 42 and 44 by rod means 38 and 40, although other suitable known driving units may be employed to engage and disengage the upper and lower dies.

The operation of the hydraulic cylinders 42 and 44 is controlled by a die control circuit 46 which controls a valve in each cylinder to cause the rods 38 and 40 to extend or retract. When the rods extend to bring the upper and lower dies 34 and 36 together, the crowns 12 on the heat exchanger plate 10 are crushed.

The heat exchanger plate 10 is fed between the upper and lower dies 34 and 36 by a suitable drive means such as opposed driven rollers 48 and 50. Ideally, essentially a continuous feeding motion is imparted to the heat exchanger plate 10, and consequently, the operation of the upper and lower dies must be accurately timed. This timing sequence is accomplished in response to sensing switches 52 54 and 56A and 56B.

Figure 3:
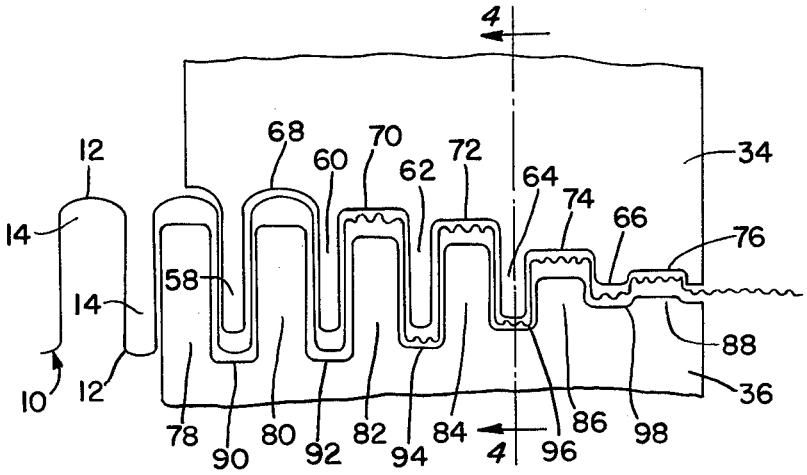
FIG. 3 is a cross sectional view of the die set used for the die assembly of FIG. 2.
Figure 4:
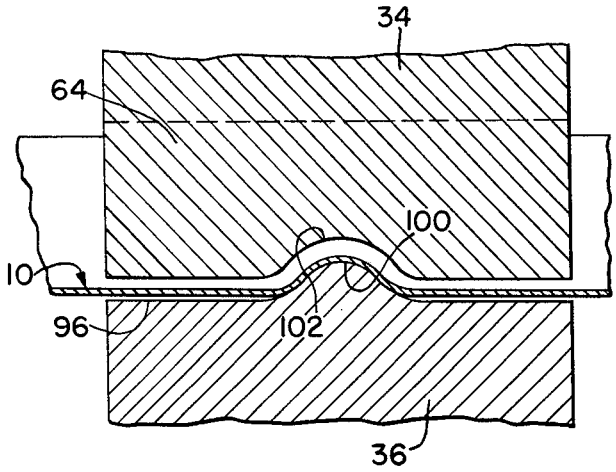
FIG. 4 is a cross sectional view of one die slot and one die blade of the die set of FIG. 3 taken along lines 4—4 of FIG. 3.

To comprehend the manner in which the die assembly 32 operates, it is first necessary to consider the structure of the upper and lower dies 34 and 36 as illustrated in FIGS. 3 and 4. The face of the upper die 34 is formed to provide a plurality of downwardly extending sequential blades 58, 60, 62, 64 and 66 which are spaced by intervening slots 68, 70, 72, 74 and 76. Similarly, the face of the lower die 36 is formed to provide a plurality of upwardly extending sequential blades 78, 80, 82, 84, 86 and 88 which are spaced by intervening slots 90, 92, 94, 96 and 98. When the upper and lower dies are engaged, the blades 80–88 enter the slots 68–76 respectively while the blades 58–66 enter the slots 90–98 respectively. It will be noted that some clearance is left between a slot and the blade received thereby to accommodate the heat exchanger plate 10.

The heat exchanger plate 10 is fed between the upper and lower dies 34 and 36 from the left in FIG. 3. The blades 58, 78 and 80 constitute entrant blades and are the first blades to enter into passages 14 in a heat exchanger plate as the plate moves between the dies. The blade 58 enters a passage on the top side of the plate while the blades 78 and 80 enter individual passages on the bottom side of the plate. These entrant blades and the slots 68 and 90 which receive them are full size and receive and support the heat exchanger plate without crushing the crowns 12. If desirable, a second full sized slot and blade combination 60 and 92 may be provided so that the top and bottom passages 14 are supported by two blades on either side of the heat exchanger plate 10 at the entrant end of the die set.

The slots 70, 72, 74 and 76 in the top die 34 and the slots 94, 96 and 98 in the bottom die 36 decrease progressively in depth so that the slots 76 and 98 at the exit end of the die set are very shallow. Thus the crowns 12 of the heat exchanger plate are progressively crushed as they move into slots of decreasing depth. To aid in this crushing operation, a projection 100 extends from the root of each slot while the opposing blade has a scalloped end as indicated at 102 in FIG. 4.

It is important to assure that an individual passage 14 on the top of the heat exchanger plate 10 cleanly and sequentially receives the blades 58, 60, 62, 64 and 66 as the plate progresses from the entrant to the exit ends of the die set. Simultaneously, an adjacent passage on the bottom side of the heat exchanger plate sequentially receives the blades 78, 80, 82, 84, 86 and 88. This is accomplished under the control of the detent switch 52 which causes the die control circuit 46 to trigger the die cylinders 42 and 44 to close the upper and lower dies 34 and 36 when the heat exchanger plate is in a precise location.

Figure 5:
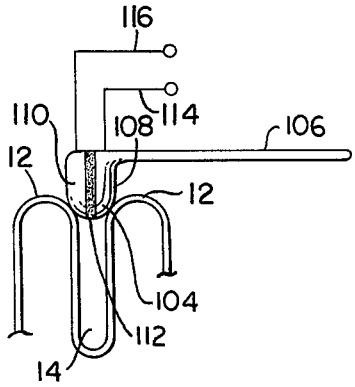
FIG. 5 is a detailed illustration of the detent switches used for the die assembly of FIG. 2.

The structure of the detent switch 52 is shown in greater detail in FIG. 5. The switch includes a detent ball 104 mounted on a spring arm 106 which spring biases the ball downwardly against the crowns 12 on the heat exchanger plate 10. The ball consists of two electrically conductive halves 108 and 110 which are electrically separated by a central insulating strip 112. Electrical conductors 114 and 116 are each connected to one of the conductive halves, so that when the ball is nested in a passage 14 as shown in FIG. 5, an electrical circuit is completed between the conductors by the conductive halves 108 and 110 and the heat exchanger plate. When the ball is not in contact with the crowns 12 on both sides of a passage 14, no electrical circuit is completed between the conductors 114 and 116.

Figure 6:
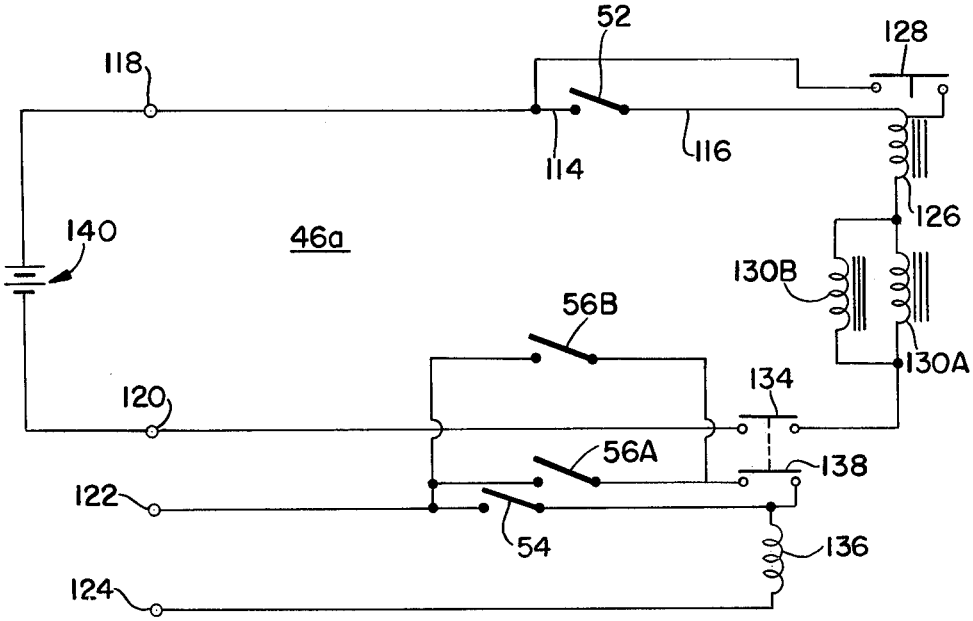
FIG. 6 is a circuit diagram of the control circuit for the die assembly of FIG. 2.

The die control circuit 46 is identical in structure and operation, for flattening both zones 24 and 26 and consequently will be described with reference to the structure of die control circuit 46 shown in FIG. 6. This circuit includes input terminals 118 and 120 which supply power to control the operation of cylinder 42 (FIG. 2), and input terminals 122 and 124 which supply power to a holding circuit. These input terminals may be connected to the same or separate power supplies, such as a battery power supply 140.

When an electrical circuit is completed between the conductors 114 and 116 by the detent switch 52, power may be provided from the terminal 118 across the detent switch to energize the coil 126 of a holding relay and close relay contact 128 to keep the holding relay actuated in the "hold" position. Power from the holding relay will flow through solenoids 130A and 130B which control a valve or other control member for the cylinders 42 and 44, and the die piston rods 38 and 40 will be extended. From the solenoids 130A and 130B, power then passes across closed contact 134 and back to terminal 120.

The contact 134 is part of a holding relay including a holding relay coil 136 which is kept energized from terminal 122 across normally closed switches 56A and 56B after the contacts 138 have been initially closed by a brief closure of switch 54 to energize the coil 136. Switches 56A and 56B open at the end of each die stroke.

Industrial Applicability

The heat exchanger plate 10 is moved between the upper and lower dies 34 and 36 by the driving wheels 48 and 50. The switches 56A and 56B are normally closed and the switch 54 is open. Therefore, the holding relay coil 136 is normally energized with the contacts 134 and 138 closed. As the heat exchanger plate is located in the correct position for the crushing operation, the detent switch 52 momentarily closes to energize holding relay coil 126 and close contacts 128. Current now flows from terminal 118 across contacts 128 and through coil 126, control solenoids 130A, 130B and contacts 134 back to terminal 120. The energization of solenoids 130A and 130B causes cylinders 42 and 44 to expand die piston rods 38 and 40 driving the dies 34 and 36 together. As the rods 38 and 40 reach the outer extent of their travel, switches 56A and 56B are momentarily opened to deenergize holding relay coil 136. This opens contacts 134 and 138 causing the deenergization of control solenoids 130A, 130B and holding relay coil 126. Upon deenergization of the control solenoids, the rods 38 and 40 are retracted to disengage the upper and lower dies 34 and 36 and reclose the switches 56A and 56B. During movement of the sheet to the next passage a switch 54 is normally closed. The switch 54 is similar to switch 52 but is positioned to close during movement of the sheet and prior to closure of switch 52 to affect the next die stroke. Switch 54 is positioned approximately ½ passage pitch different from switch 52 so that movement of the sheet alternately engages switches 52 and 54. This assures that switch 54 will close prior to the point where the passage in position for switch 52 to close and actuate the die stroke.

The detent switch 52 is located closely adjacent the blades 58 and 80 at the entrant end of the die set and is spaced relative to these blades so that these entrant blades serve as locators for the remaining blades in the die set. Each time a detent switch bridges two adjacent crowns 12, the die set comes together and the blades formed in the faces of the opposed dies enter the passages 14 which are aligned therewith. The slots 70–76 and 94–98 progressively crush the crowns 12 received thereby while the intervening blades prevent the crushed crowns from expanding to block the passages 14. Each crown is subjected to a plurality of separate successive crushing operations until it reaches either the slot 76 or the slot 98. These final exit slots are so shallow that full crushing of the transition zones 24 and 26 is completed thereby. After these transition zones are completely crushed, the remainder of the header zones 20 and 22 is crushed in the conventional manner.

It is obvious that the blades in the faces of the upper and lower dies 34 and 36 will be formed to conform to the configuration of the passages 14 in the heat exchanger plate 10. Therefore, when the passages are wavy in configuration as shown in FIG. 1, to enhance heat transfer, the blades will be similarly configured to conform therewith. Also, if the passages in one side of the plate vary in width from the passages on the opposite side, the width of the blades will also vary accordingly. Thus, as will be noted in FIG. 3, the blades in the face of the lower die 36 are wider than those in the face of the upper die 34.

The foregoing has described a method and apparatus for use in the formation of thin metal plates used in heat exchangers.

It is anticipated that aspects of the present invention, other than those specifically defined in the appended claims, can be obtained from the foregoing description and the drawings.

I claim:

1. A method for crushing a portion of corrugated sheet in an area extending transversely to the corrugations thereof without blocking the passages between the ridges of the uncrushed portion of said corrugated sheet which includes the steps of inserting a spacing member into each of the passages on both sides of at least one ridge of said corrugated sheet in a transition area in the area to be crushed located between the uncrushed portion of said corrugated sheet and the remainder of the area to be crushed, crushing the ridge in the area between the spacing members, withdrawing the spacing members, subsequently crushing the remainder of the area to be crushed without the use of spacing members.

2. The method of claim 1 which includes simultaneously crushing at least one ridge on the top and one ridge on the bottom of said corrugated sheet in said transition zone after inserting spacing members on both sides of said ridges.

3. The method according to claim 1 which includes progressively crushing said ridge in a plurality of spaced, sequential crushing operations until said ridge is substantially flattened, said ridge being crushed in each of said crushing operations to an extent greater than that accomplished in the preceding crushing operation.

4. A method for crushing a portion of a corrugated metallic sheet in an area extending transversely to the corrugations thereof without blocking the passages between the ridges of the uncrushed portion of said corrugated sheet which includes the steps of creating relative movement between the sheet and a plurality of sequentially arranged, spaced crushing stations to move the ridges in a portion of said corrugated sheet individually past each of said crushing stations in sequence, inserting at each crushing station a spacing member into each of the passages on both sides of at least one ridge of said corrugated sheet, progressively crushing the ridge between said spacing members at each of said sequential crushing stations until said ridge is substantially flattened and withdrawing the spacing members at each crushing station after the crushing operation at said station is completed.

5. The method according to claim 4 which includes simultaneously crushing a ridge in the top surface of said corrugated sheet and a ridge on the bottom surface of said corrugated sheet at each of said crushing stations.

6. The method according to claim 5 which includes crushing each of the individual ridges in a transition area between the uncrushed portion of said corrugated sheet and the remainder of the area to be crushed using said spacing members and subsequently crushing the remainder of said area to be crushed without using said spacing members.

* * * * *